US008313183B2

(12) United States Patent
Platt et al.

(10) Patent No.: US 8,313,183 B2
(45) Date of Patent: Nov. 20, 2012

(54) IMMERSED HIGH SURFACE AREA HEATER FOR A SOLID INK RESERVOIR

(75) Inventors: David Paul Platt, Newberg, OR (US); Brent Rodney Jones, Sherwood, OR (US); Edward Francis Burress, West Linn, OR (US); Joseph Andrew Broderick, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 145 days.

(21) Appl. No.: 12/940,768

(22) Filed: Nov. 5, 2010

(65) Prior Publication Data

US 2012/0113172 A1 May 10, 2012

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS

| | | | | |
|---|---|---|---|---|
| 3,032,635 | A | 5/1962 | Kraft | |
| 4,447,705 | A | 5/1984 | Bullock | |
| 4,490,731 | A | 12/1984 | Vaught | |
| 4,771,920 | A * | 9/1988 | Boccagno et al. | 222/146.5 |
| 4,791,439 | A | 12/1988 | Guiles | |
| 4,797,534 | A | 1/1989 | Prager et al. | |
| 5,028,763 | A | 7/1991 | Chung-Tai | |
| 5,424,767 | A | 6/1995 | Alavizadeh et al. | |
| 5,446,264 | A | 8/1995 | Kondo et al. | |
| 5,500,663 | A * | 3/1996 | Ujita et al. | 347/86 |
| 5,621,444 | A * | 4/1997 | Beeson | 347/88 |
| 5,784,089 | A | 7/1998 | Crawford | |
| 5,939,972 | A | 8/1999 | Nagao et al. | |
| 6,024,433 | A | 2/2000 | Tsurui et al. | |
| 6,094,207 | A | 7/2000 | Wen et al. | |
| 6,132,038 | A * | 10/2000 | Szlucha | 347/102 |
| 6,242,712 | B1 | 6/2001 | Prust | |
| 6,276,790 | B1 | 8/2001 | Ikezaki | |
| 6,860,591 | B2 | 3/2005 | Slotto et al. | |
| 7,011,399 | B2 | 3/2006 | Godil et al. | |
| 7,207,668 | B2 | 4/2007 | Jones et al. | |
| 7,264,335 | B2 | 9/2007 | Silverbrook et al. | |
| 7,448,736 | B2 | 11/2008 | Hong et al. | |
| 7,568,795 | B2 | 8/2009 | Freitag et al. | |
| 7,611,236 | B2 | 11/2009 | Park | |

(Continued)

FOREIGN PATENT DOCUMENTS

EP 2 208 619 A1 7/2010

(Continued)

OTHER PUBLICATIONS

UK Search Report of the UK Intellectual Property Office corresponding to GB Application No. GB1118803.4, UKIPO, Newport, South Wales, Feb. 29, 2012 (3 pages).

*Primary Examiner* — Laura Martin

(74) *Attorney, Agent, or Firm* — Maginot, Moore & Beck, LLP

(57) ABSTRACT

A volumetric container for storing phase-change ink includes a housing that is comprised primarily of a thermally insulating material and a heater element positioned within the housing. The heater element is positioned in the container to melt solid ink quickly to enable printing operations.

19 Claims, 7 Drawing Sheets

U.S. PATENT DOCUMENTS

| | | | | |
|---|---|---|---|---|
| 7,654,639 | B2 | 2/2010 | Park et al. | |
| 7,667,166 | B2 | 2/2010 | Zeyen et al. | |
| 2004/0114007 | A1* | 6/2004 | Leighton | 347/88 |
| 2005/0146584 | A1 | 7/2005 | Godil et al. | |
| 2006/0250457 | A1 | 11/2006 | Park et al. | |
| 2007/0103523 | A1 | 5/2007 | Snyder et al. | |
| 2008/0088676 | A1 | 4/2008 | Silverbrook | |
| 2009/0244225 | A1 | 10/2009 | Hays et al. | |
| 2010/0192685 | A1 | 8/2010 | Sabanovic et al. | |
| 2010/0194835 | A1 | 8/2010 | Jones | |

FOREIGN PATENT DOCUMENTS

| | | |
|---|---|---|
| JP | 63-260447 | 10/1988 |
| JP | 01-278362 | 11/1989 |

* cited by examiner

IMMERSED HIGH SURFACE AREA HEATER FOR A SOLID INK RESERVOIR

TECHNICAL FIELD

The apparatus and method described below relates to devices for heating phase change ink, and more particularly to using immersed heaters in an ink reservoir to melt solidified ink.

BACKGROUND

Inkjet printers eject drops of liquid ink from inkjet ejectors to form an image on an image receiving surface, such as an intermediate transfer surface, or a media substrate, such as paper. Full color inkjet printers use a plurality of ink reservoirs to store a number of differently colored inks for printing. A commonly known full color printer has four ink reservoirs. Each reservoir stores a different color ink, namely, cyan, magenta, yellow, and black ink, for the generation of full color images.

Phase change inkjet printers utilize ink that remains in a solid phase at room temperature, often with a waxy consistency. After the ink is loaded into a printer, the solid ink is transported to a melting device, which melts the solid ink to produce liquid ink. The liquid ink is stored in a reservoir that may be either internal or external to a printhead. The liquid ink is provided to the inkjet ejectors of the printhead as needed. If electrical power is removed from the printer to conserve energy or for printer maintenance, the melted ink begins to cool and may eventually return to the solid form. In this event, the solid ink needs to be melted again before the ink can be ejected by a printhead. Consequently, the time taken to melt the ink impacts the availability of a solid ink printer for printing operations. Therefore, improvements to the devices in a printer that heat and store melted ink are desirable.

SUMMARY

A volumetric container for storage of ink in a solid inkjet printer has been developed. The container includes a housing comprised of thermally insulating material having a volume of space internal to the housing, the volume of space having a height, a width, and a depth, and a heater element positioned within the volume of space of the housing to melt ink uniformly across the width of the volume of space. The heater element is configured to have a surface area that is greater than an area defined by the height and width of the volume of space.

DETAILED DESCRIPTION

Figure 1:
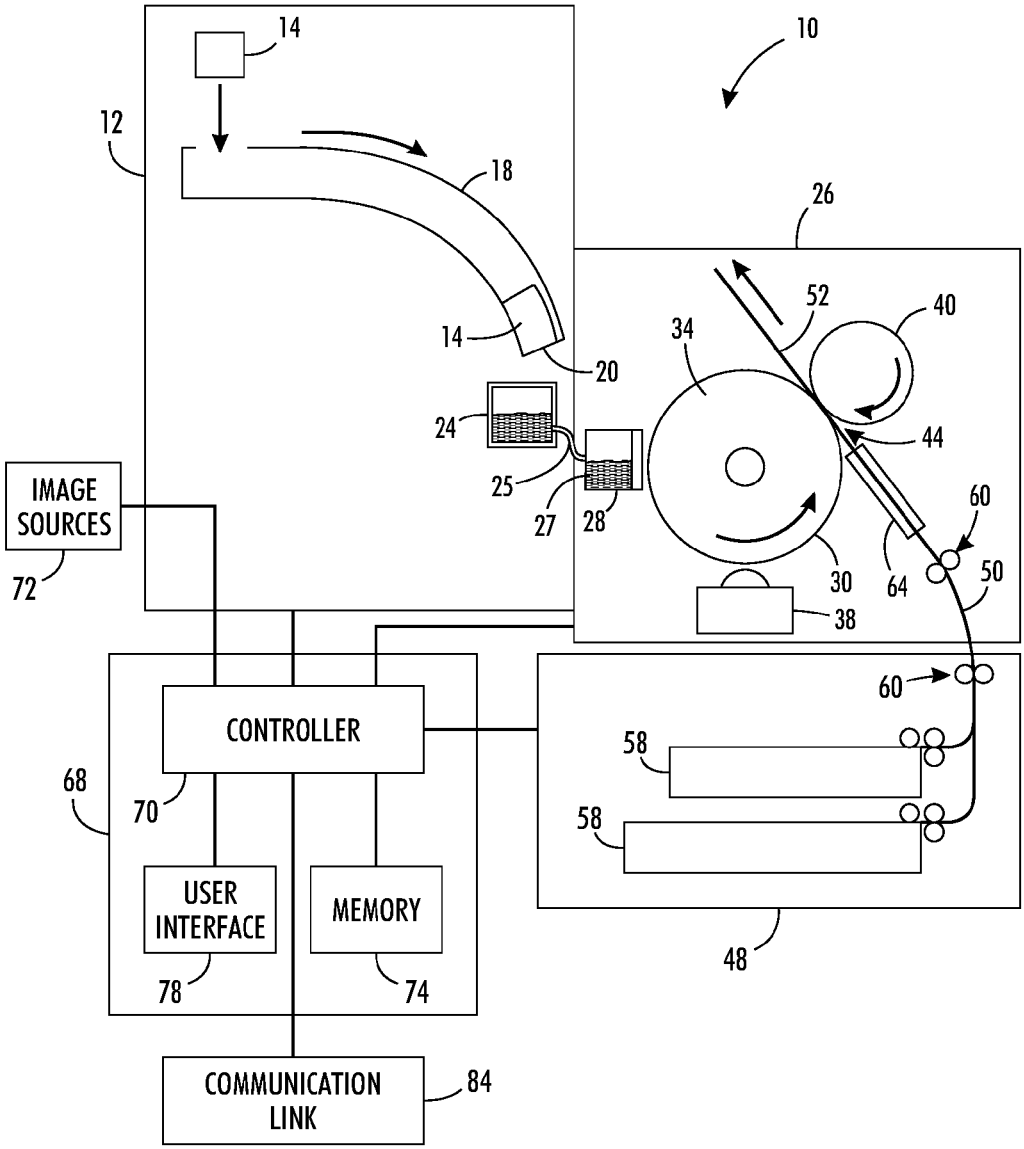
FIG. 1 is a schematic view of an indirect inkjet printing system.

The description below and the accompanying figures provide a general understanding of the environment for the system and method disclosed herein as well as the details for the system and method. In the drawings, like reference numerals are used throughout to designate like elements. The word "printer" as used herein encompasses any apparatus, such as a digital copier, bookmaking machine, facsimile machine, multi-function machine, etc. which performs a print outputting function for any purpose. While the specification focuses on a system that controls the melting of solid ink in a solid ink reservoir, the apparatus for melting ink in a reservoir may be used with any device that uses a phase-change fluid that has a solid phase. Furthermore, solid ink may be called or referred to herein as ink, ink sticks, or sticks. The term "parametric volume" refers to a volume defined by an envelope around the form of an object, such as a heater element, that may include gaps and cavities. Thus, the parametric volume of an object includes open spaces within the object as well as the volume of material forming the object. Parametric volume as used in this document means an interior volume of a tight fitting, multi-sided box into which the heater fits. Similarly, the term "parametric thickness" refers to a thickness of an object, such as a heater element, that may include openings or gaps. For example, a corrugated object has a parametric thickness extending from the top of one corrugation to the bottom of another corrugation.

FIG. 1 is a side schematic view of an embodiment of a phase change ink imaging device configured for indirect or offset printing using melted phase change ink. The device 10 of FIG. 1 includes an ink handling system 12, a printing system 26, a media supply and handling system 48, and a control system 68. The ink handling system 12 receives and delivers solid ink to a melting device for generation of liquid ink. The printing system 26 receives the melted ink and ejects liquid ink onto an image receiving surface under the control of system 68. The media supply and handling system 48 extracts media from one or more supplies in the device 10, synchronizes delivery of the media to a transfix nip for the transfer of an ink image from the image receiving surface to the media, and then delivers the printed media to an output area.

In more detail, the ink handling system 12, which is also referred to as an ink loader, is configured to receive phase change ink in solid form, such as blocks of ink 14, which are commonly called ink sticks. The ink loader 12 includes feed channels 18 into which ink sticks 14 are inserted. Although a single feed channel 18 is visible in FIG. 1, the ink loader 12 includes a separate feed channel for each color or shade of color of ink stick 14 used in the device 10. The feed channel 18 guides ink sticks 14 toward a melting assembly 20 at one end of the channel 18 where the sticks are heated to a phase change ink melting temperature to melt the solid ink to form liquid ink. Any suitable melting temperature may be used depending on the phase change ink formulation. In one embodiment, the phase change ink melting temperature is approximately 100° C. to 140° C. The melted ink is received in a reservoir 24 configured to maintain a quantity of the melted ink in molten form for delivery to printing system 26 of the device 10. In alternative embodiments, a single reservoir 24 may supply ink to multiple printheads such as printhead 28. While one intermediate reservoir 24 is shown for simplicity, imaging device 10 may include multiple reservoirs, one for maintaining melted ink of each color of ink used in the device, such as, for example cyan, magenta, yellow, and black (CMYK). As seen in further detail below, a heater element is positioned within reservoir 24.

The printing system 26 includes at least one printhead 28 including a printhead reservoir 27 having inkjets arranged to eject drops of melted ink onto an intermediate surface 30. Printhead reservoir 27 receives molten ink from reservoir 24 via a conduit 25. Printhead reservoir 27 contains a heater element, as shown in further detail below. One printhead is shown in FIG. 1 although any suitable number of printheads 28 may be used. The printheads are operated in accordance with firing signals generated by the control system 68 to eject ink onto the intermediate surface 30.

The intermediate surface 30 comprises a layer or film of release agent applied to a rotating member 34 by the release agent application assembly 38, which is also known as a drum maintenance unit (DMU). The rotating member 34 is shown as a drum in FIG. 1 although in alternative embodiments the rotating member 34 may comprise a moving or rotating belt, band, roller or other similar type of structure. A nip roller 40 is loaded against the intermediate surface 30 on rotating member 34 to form a nip 44 through which sheets of recording media 52 are fed in timed registration with the ink drops deposited onto the intermediate surface 30 by the inkjets of the printhead 28. Pressure (and in some cases heat) is generated in the nip 44 that, in conjunction with the release agent that forms the intermediate surface 30, facilitates the transfer of the ink drops from the surface 30 to the recording media 52 while substantially preventing the ink from adhering to the rotating member 34.

The media supply and handling system 48 of device 10 is configured to transport recording media along a media path 50 defined in the device 10 that guides media through the nip 44, where the ink is transferred from the intermediate surface 30 to the recording media 52. The media supply and handling system 48 includes at least one media source 58, such as supply tray 58 for storing and supplying recording media of different types and sizes for the device 10. The media supply and handling system includes suitable mechanisms, such as rollers 60, which may be driven or idle rollers, as well as baffles, deflectors, and the like, for transporting media along the media path 50.

The media path 50 may include one or more media conditioning devices for controlling and regulating the temperature of the recording media so that the media arrives at the nip 44 at a suitable temperature to receive the ink from the intermediate surface 30. For example, in the embodiment of FIG. 1, a preheating assembly 64 is provided along the media path 50 for bringing the recording media to an initial predetermined temperature prior to reaching the nip 44. The preheating assembly 64 may rely on radiant, conductive, or convective heat or any combination of these heat forms to bring the media to a target preheat temperature, which in one practical embodiment, is in a range of about 30° C. to about 70° C. In alternative embodiments, other thermal conditioning devices may be used along the media path before, during, and after ink has been deposited onto the media for controlling media (and ink) temperatures.

A control system 68 aids in operation and control of the various subsystems, components, and functions of the imaging device 10. The control system 68 is operatively connected to one or more image sources 72, such as a scanner system or a work station connection, to receive and manage image data from the sources and to generate control signals that are delivered to the components and subsystems of the printer. Some of the control signals are based on the image data, such as the firing signals, and these firing signals operate the printheads as noted above. Other control signals cause the components and subsystems of the printer to perform various procedures and operations for preparing the intermediate surface 30, delivering media to the transfix nip, and transferring ink images onto the media output by the imaging device 10.

The control system 68 includes a controller 70, electronic storage or memory 74, and a user interface (UI) 78. The controller 70 comprises a processing device, such as a central processing unit (CPU), an application specific integrated circuit (ASIC), a field programmable gate array (FPGA) device, or a microcontroller. Among other tasks, the processing device processes images provided by the image sources 72. The one or more processing devices comprising the controller 70 are configured with programmed instructions that are stored in the memory 74. The controller 70 executes these instructions to operate the components and subsystems of the printer. Any suitable type of memory or electronic storage may be used. For example, the memory 74 may be a non-volatile memory, such as read only memory (ROM), or a programmable non-volatile memory, such as EEPROM or flash memory.

User interface (UI) 78 comprises a suitable input/output device located on the imaging device 10 that enables operator interaction with the control system 68. For example, UI 78 may include a keypad and display (not shown). The controller 70 is operatively coupled to the user interface 78 to receive signals indicative of selections and other information input to the user interface 78 by a user or operator of the device. Controller 70 is operatively coupled to the user interface 78 to display information to a user or operator including selectable options, machine status, consumable status, and the like. The controller 70 may also be coupled to a communication link 84, such as a computer network, for receiving image data and user interaction data from remote locations.

The controller 70 generates control signals that are output to various systems and components of the device 10, such as the ink handling system 12, printing system 26, media handing system 48, release agent application assembly 38, media path 50, and other devices and mechanisms of the imaging device 10 that are operatively connected to the controller 70. Controller 70 generates the control signals in accordance with programmed instructions and data stored in memory 74. The control signals, for example, control the operating speeds, power levels, timing, actuation, and other parameters, of the system components to cause the imaging device 10 to operate in various states, modes, or levels of operation, that are denoted in this document collectively as operating modes. These operating modes include, for example, a startup or warm up mode, shutdown mode, various print modes, maintenance modes, and power saving modes.

Figure 2:
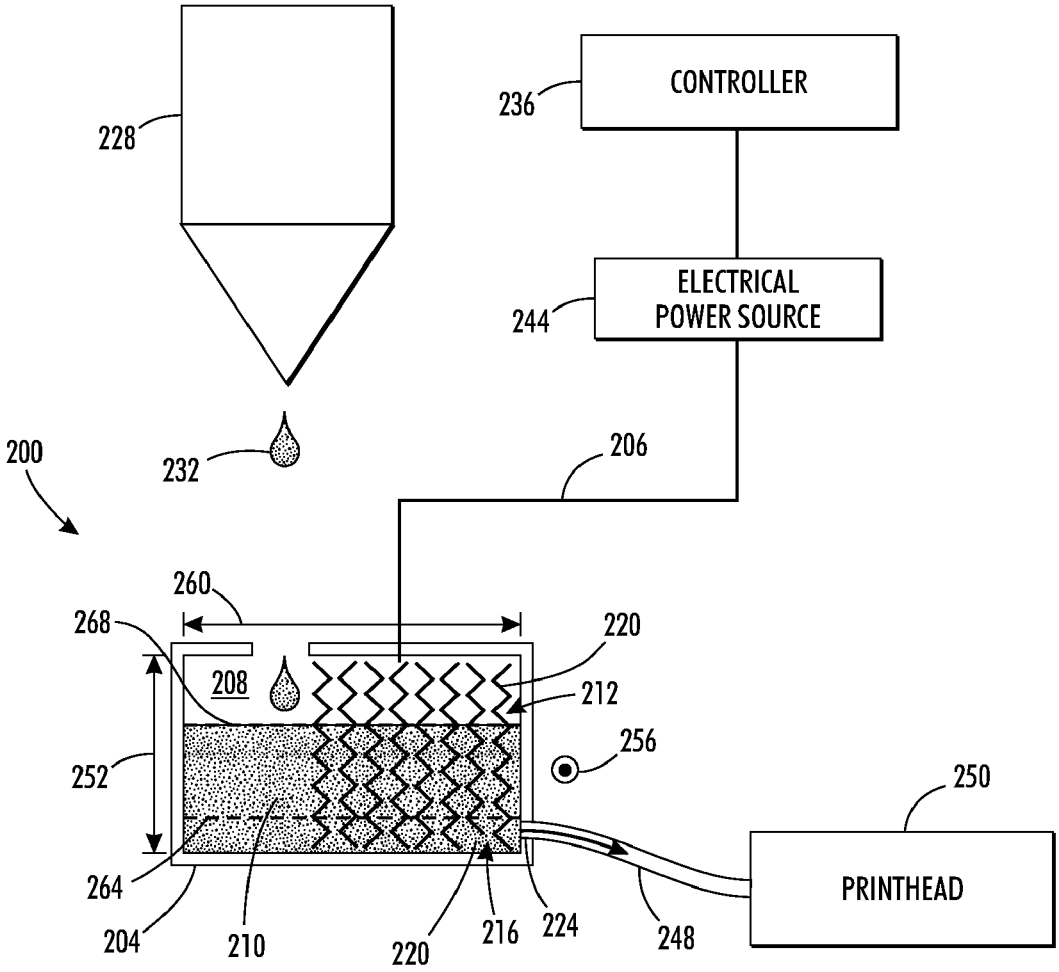
FIG. 2 is a schematic diagram of an ink reservoir including a heater element.

FIG. 2 depicts an ink reservoir 200 including an insulated housing 204, reservoir volume 208 with ink 210, heater element 212, and outlet 224. A conduit 248 connects outlet 224 of reservoir volume 208 to a printhead 250. Electrical leads 206 connect heater element 212 to an electrical power source 244. A controller 236 is operatively connected to the electrical power source 244. Ink reservoir 200 holds liquid ink of a single color received from a melting assembly 228, and multiple ink reservoirs may be used in a color imaging device.

Housing 204 is a volumetric container that is primarily composed of a thermally insulating material that is compatible with various phase change inks in both the solid and molten phases. Various plastics, including thermoplastics, and elastomeric materials are suitable for use in the housing 204. Additionally, housing 204 may comprise one or more layers of both thermally insulating and thermally conductive materials. The materials of housing 204 are configured to provide at least moderate heat retention within reservoir volume 208. Reservoir volume 208 has an internal height 252, width 256 (extending through the page), and depth 260. The upper liquid level for a volume of ink within the reservoir may be well below the upper reservoir confinement. such a configuration enables ink to be retained even when the product is tipped at an angle. The reservoir may be vented, partially open or fully open at the top.

The exemplary heater element 212 includes multiple heating members, such as vane-like heating member 220, that extend substantially across the width 256 of the reservoir volume 208. The shape of heater element 212 provides a surface area exposed to ink 210 that is greater than a surface area defined by the height 252 and width 256 of reservoir volume 208. Heater element 212 occupies a position in reservoir volume 208 that is proximate to conduit 248 to expedite melting of ink near the conduit, and the heater element extends from the bottom of reservoir volume 208 toward the top of reservoir volume 208. The parametric volume of heater element 212 is greater than 50% of the total volume of reservoir volume 208 up to the upper liquid volume level 268. The upper liquid volume level limits the volume of ink in reservoir 200 to enable a portion of reservoir volume 208 to remain unfilled during operation. Heater element 212 extends below a low limit fluid level, shown by dashed line 264. As used herein, the term "low limit fluid level" refers to a minimum level of a fluid, such as ink, held in a fluid reservoir during operation. As the fluid level in a reservoir reaches the low limit fluid level, the printer may suspend operation or take other actions to ensure that the fluid level in reservoir volume 208 exceeds the low limit fluid level.

In one embodiment, the heater element 212 is formed from a positive thermal coefficient (PTC) material and may be a modified shape PTC thermistor. A PTC material exhibits an increased resistance to a flow of electrical current in response to an increase in temperature of the material. The PTC material, which may be a ceramic like substance, may be formed into a heater and coated, as appropriate or required, for chemical compatibility with the ink or other material being heated. Electrical leads 206 extend from the heater element 212 through the top of housing 204. In the embodiment of FIG. 2, the heater element 212 may be removed from the ink reservoir 200 if the reservoir is configured with a removable or displaceable top or cover (not shown). Electrical leads 206 may also extend through upper portions of the side walls of housing 204 at a level above the ink 210 in the reservoir volume 208. Leads 206 may extend through a grommet or threaded cap to facilitate removal and replacement of the heater element 212.

Figure 5A:
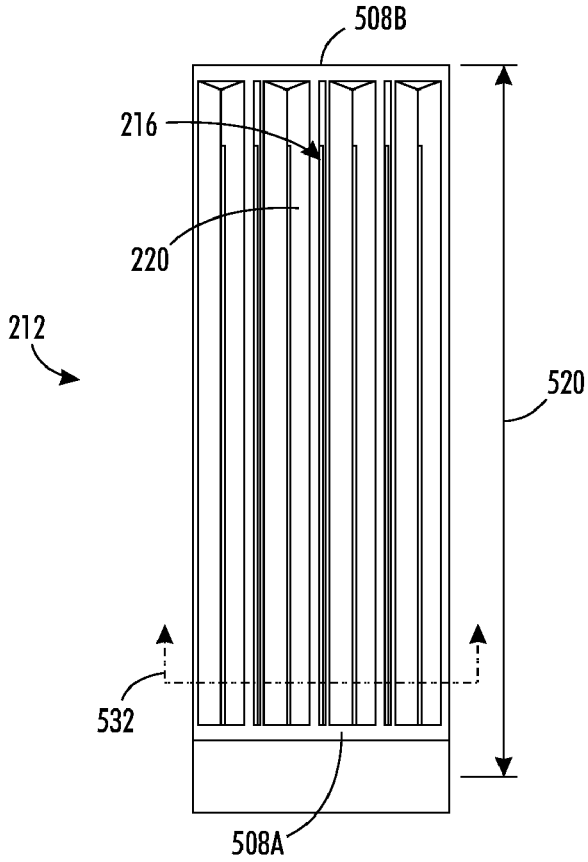
FIG. 5A is a top view of a PTC heater element that may be placed in a solid ink reservoir.
Figure 5B:
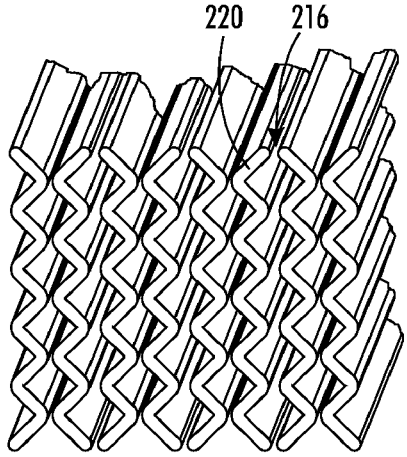
FIG. 5B is a cross-sectional view through the heater element of FIG. 5A taken along line 524.

FIG. 5A and FIG. 5B depict heater element 212 in isolation. The heater element 212 includes multiple angled vane-like members 220 and end plates 508A and 508B. Heater element 212 has a width 520 that is similar to the width of the reservoir volume 208. Gaps 216 between the vanes 220 in heater element 212 enable ink to flow into and through the heater element 212 to promote ink contact over the surface of heater element 212. As shown in FIG. 5B, gaps 216 extend between each of the vane-like members 220. End plates 508A and 508B hold the vane members 220 in place, and provide contacts for electrical leads, such as leads 206. When activated, heater element 212 heats in a uniform manner across width 520. Thus, ink in a reservoir that contains heater element 212 melts uniformly along the width of the heater element.

Figure 6A:
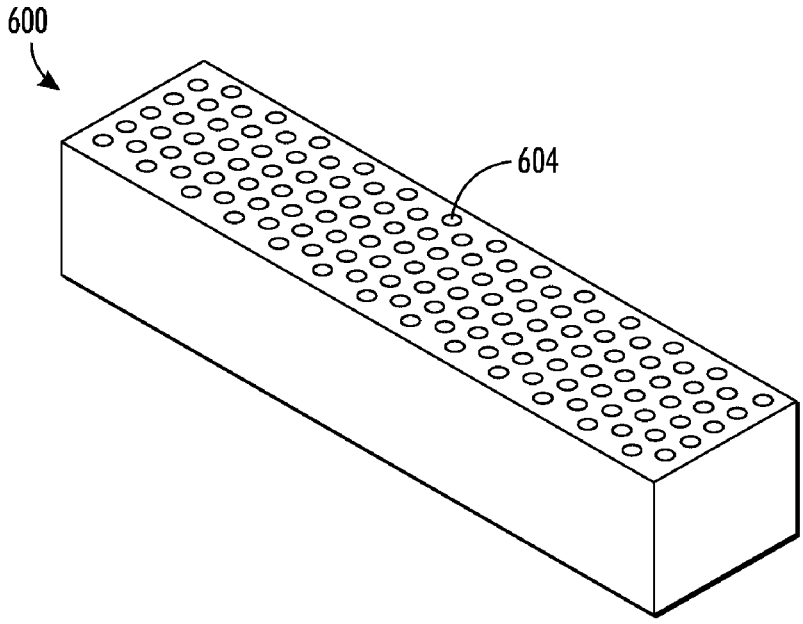
FIG. 6A is a top view of a perforated heater element that may be placed in a solid ink reservoir.
Figure 6B:
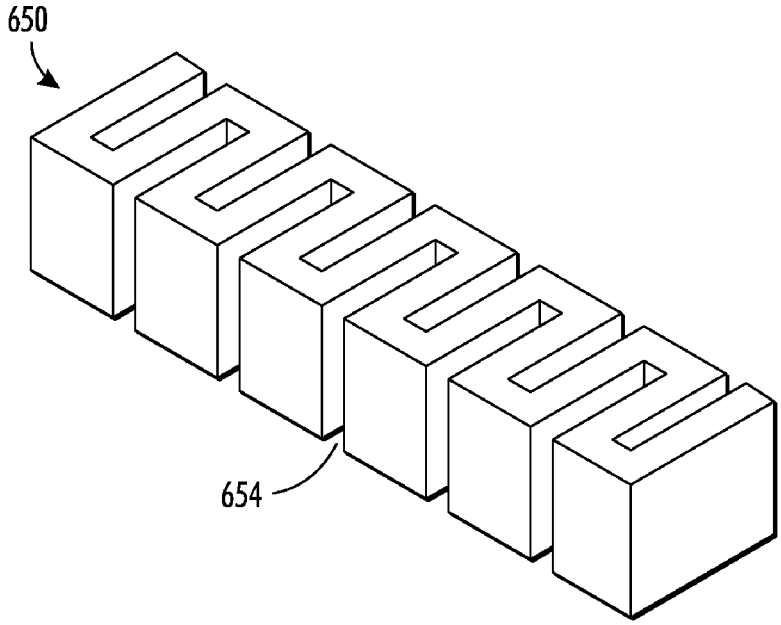
FIG. 6B is a top view of an another perforated element that may be placed in a solid ink reservoir.

As seen in FIG. 6A and FIG. 6B, alternative heater element designs may employ a perforated block of PTC material. The perforations extend through the block to enable ink to pass through the block in a manner similar to that of ink passing through gaps 216 in the vane members 220. The term perforation as used herein extends beyond through holes or slots to any shape having an interrupted surface that a solidifying material could take, for example, a moldable form. In FIG. 6A, a plurality of through holes 604 perforate block 600. In FIG. 6B, block 650 has a serpentine shape forming multiple channels 654 through the block. Both of the perforated blocks 600 and 650 have configurations that enable liquid ink to flow through the blocks. Ink that solidifies around or within the perforations in the blocks melts quickly when the blocks heat.

Referring again to FIG. 2, in operation, melting assembly 228 heats solid phase change ink to a melting temperature, enabling melted ink 222 to flow into the reservoir volume 208 holding ink 210. Controller 236 activates electrical power source 244 to enable electrical current to flow to heater element 212. The heater 212 establishes and then maintains the ink in a liquid state during various operational modes of the printer. The ink may flow through outlet 224 and conduit 248 to the printhead 250.

In another mode of operation, ink 210 occupies reservoir volume 208 in a solid phase. Controller 236 may deactivate electrical power source 244 to allow the ink 210 to cool and solidify according to various energy saving programs and techniques that are known to the art. Controller 236 is typically an electronic control system and may be embodied by the controller 70 described above. Ink 210 may also solidify when a printing device is removed from electrical power for a time period sufficient to allow the ink to cool to or below the solidification point. When electrical power supply 244 activates the heater element 212, the solid ink 210 in areas proximate to the heater element 212 begin to melt first. Molten ink flows through gaps, such as gap 216 provided between individual elements of heater element 212, and enters conduit 248 from outlet 224. The location of heater element 212 at a position proximate to outlet 224 enables melted ink to flow through the conduit 248 quickly after the heater 212 begins to heat. While ink melts uniformly along the width 256 of reservoir volume 208, ink located near the wall of housing 204 opposite conduit 248 is positioned farther from the heater element 212, and may melt more slowly than ink closer to the heater element 212. Thus, melted ink may flow through conduit 248 to printhead 250 even if other portions of the ink 210 in the reservoir volume remain solid or at a temperature lower than the elevated operational temperature.

During both modes of operation described above, a portion of heater element 212, shown as portion 214 in FIG. 2, may extend above the level of ink 210 in the reservoir volume 208. Ink 210 draws heat away from portions of the heater element immersed in ink 210, and air surrounding the exposed portion 214 draws heat at a lower rate than the ink 210. The PTC material used to form heater element 212 prevents the exposed portion 214 from reaching a temperature that could damage the ink, heater element 212, or other components in the ink reservoir 200. As the temperature of the exposed portion 214 rises, the resistance to electrical current in the exposed portion also rises in response to the increased temperature. The increased resistance reduces the flow of electrical current, and the temperature and electrical current balance at a temperature that allows the heater element 212 to operate while immersed in ink 210 or when exposed to air. The immersed portion of heater element 212 also reaches an equilibrium temperature that maintains the ink 210 in a molten phase without heating the ink to a temperature that is above an operational temperature range. A heater formed from PTC material does not require a closed loop system that uses a temperature sensor; however, at some printer states occurring at lower temperatures, such as standby or other low energy states, monitoring the temperature of ink that has not fully solidified may enable energy savings.

Figure 3:
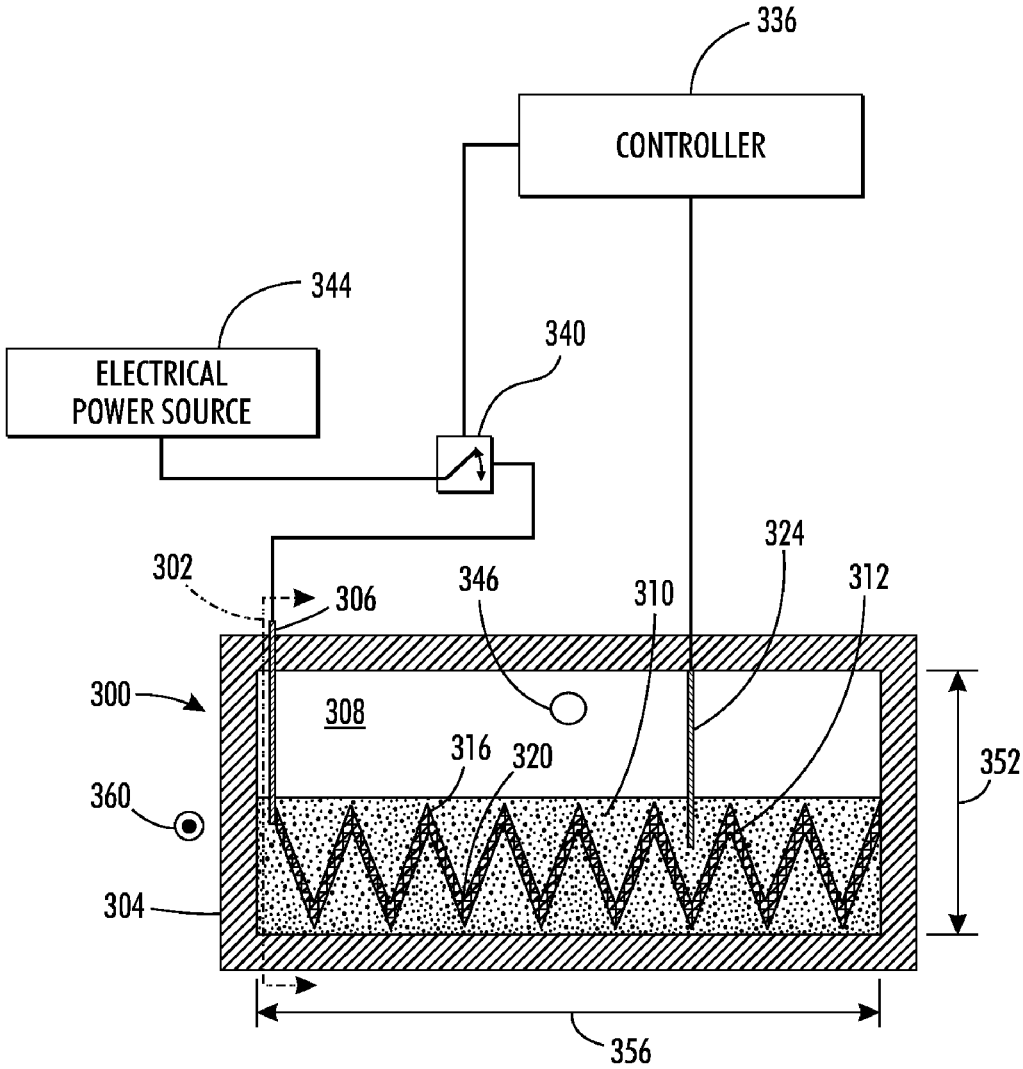
FIG. 3 is a frontal view of a printhead ink reservoir depicting a heater element inside the printhead reservoir.
Figure 4:
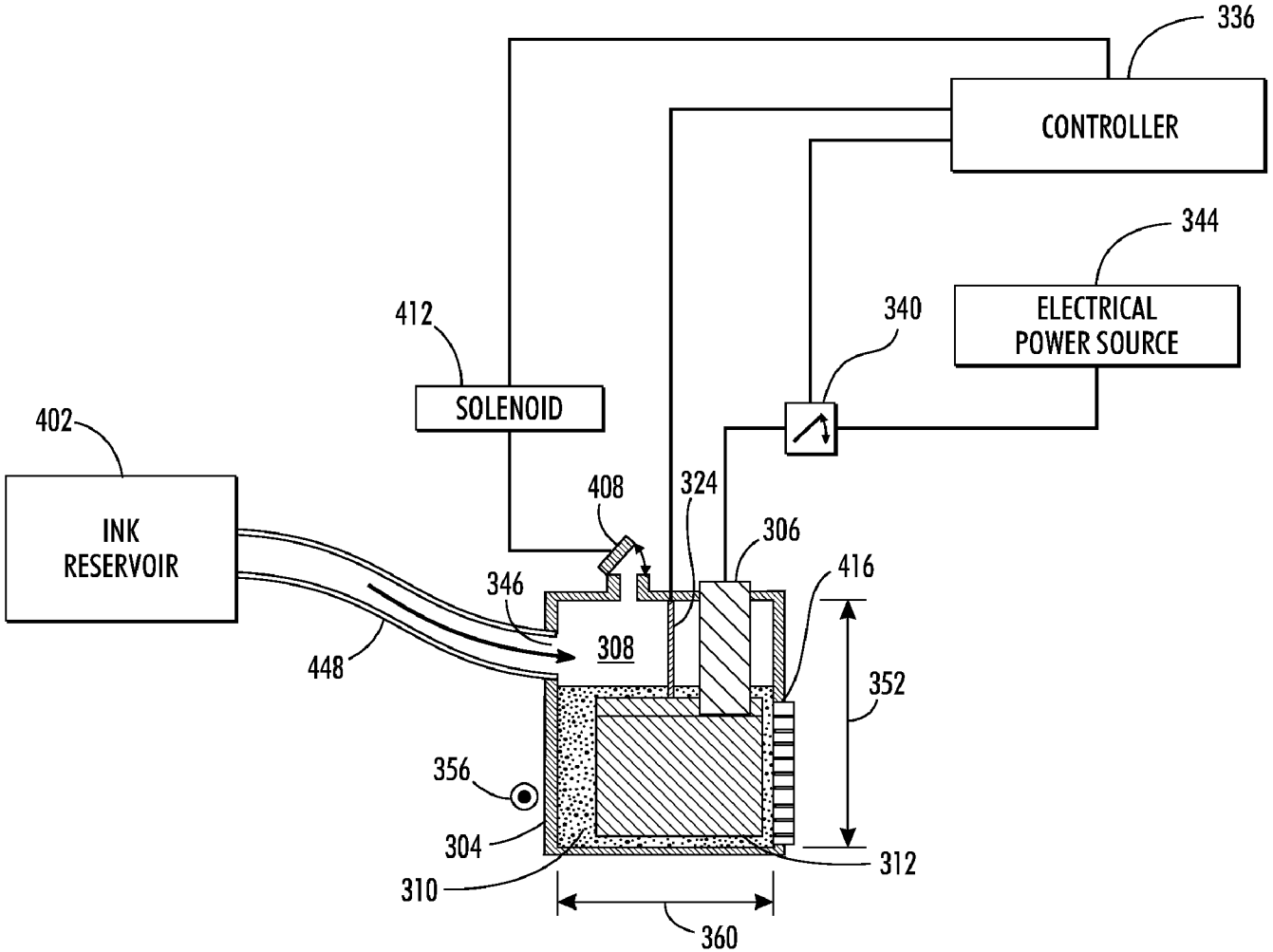
FIG. 4 is a side cross-sectional view of the printhead ink reservoir of FIG. 3 taken along line 302.

FIG. 3 and FIG. 4 depict a printhead reservoir 300 having a housing 304, internal reservoir volume 308, electrical leads 306, heater element 312, ink inlet port 346 and temperature sensor 324. Heater element 312 is a non-PTC resistive heater that may be of any appropriate construction, such as, for example, a silicone or polyamide film laminate encapsulating heating film or trace, as well known in the industry. A switch 340 operatively connects electrical power source 344 to the electrical leads 306. A controller 336 is operatively connected to the temperature sensor 324 and switch 340. FIG. 4 depicts the printhead reservoir 300 of FIG. 3 taken along line 302. FIG. 4 additionally depicts an ink reservoir 402, valve 408, solenoid 412, plurality of inkjet ejectors 416, and a conduit 448. Printhead reservoir 300 ink 310 stores a single color supplied from ink reservoir 402.

Housing 304 is primarily composed of a thermally insulating material that is compatible with various phase change inks in both the solid and molten phases. Housing 304 is a volumetric container having an internal volume, seen here as reservoir volume 308, having a height 352, width 356, and depth 360. Reservoir volume 308 holds ink received from ink reservoir 402 through conduit 448 and inlet 346. Various plastics, including thermoset plastics, thermoplastics, and elastomeric materials compatible with reservoir operational temperatures are suitable for use in the housing 304 where any of these materials provides at least a moderate degree of thermal insulation, such as a material that provides at least 20 times more thermal insulation than an aluminum housing as traditionally used. Additionally, housing 304 may comprise one or more internal voids or layers of thermally insulating materials. As shown in FIG. 4, valve 408 extends through the top of housing 304 and opens selectively in response to solenoid 412 that operates in response to signals generated by controller 336. The valve opens to enable equalization of air pressure between the reservoir volume 308 and the outside atmosphere as known in existing printing systems. Valve 408 optionally includes an insulated stopper to minimize heat dissipation through valve 408 when valve 408 is closed. Venting may alternatively be provided with an open port or air passage.

As shown in FIG. 3, heater element 312 is positioned proximate to the bottom of housing 304 and proximate to inkjet ejectors 416. Heater element 312 includes a plurality of corrugated bends 316 and 320. The folded shape of heater element 312 increases the parametric thickness and reduces the overall length of the heater 312 taken along the width 356 of housing 304. The selected folding reduces the length of heater 312 by at least one-fourth the length of the heater element 312 in comparison to an unfolded configuration. Heater element 312 has a corrugated configuration, although various other folded shapes may be used. The orientation of the corrugated bends relative to the reservoir are horizontal, as shown is FIG. 3, but could as easily be vertical or at some angle. The illustrations are not intended to limit in any way how the heater strip may be formed or oriented in use. Heater element 312 extends substantially across the width 356 of reservoir volume 308, enabling heater element 312 to apply heat in a uniform manner across the width of reservoir volume 308. As seen in FIG. 3 and FIG. 4, the parametric volume of heater element 312 is greater than 50% of the maximum fluid volume (at the upper fluid level limit) held in reservoir volume 308. Electric leads 306 enable electric current to flow into the heater element 312 from the electrical power source 344. The leads 306 extend through the top of housing 304. Heater element 312 may be removed by pulling the leads 306 and heater element 312 through the top of housing 304.

Figure 7:
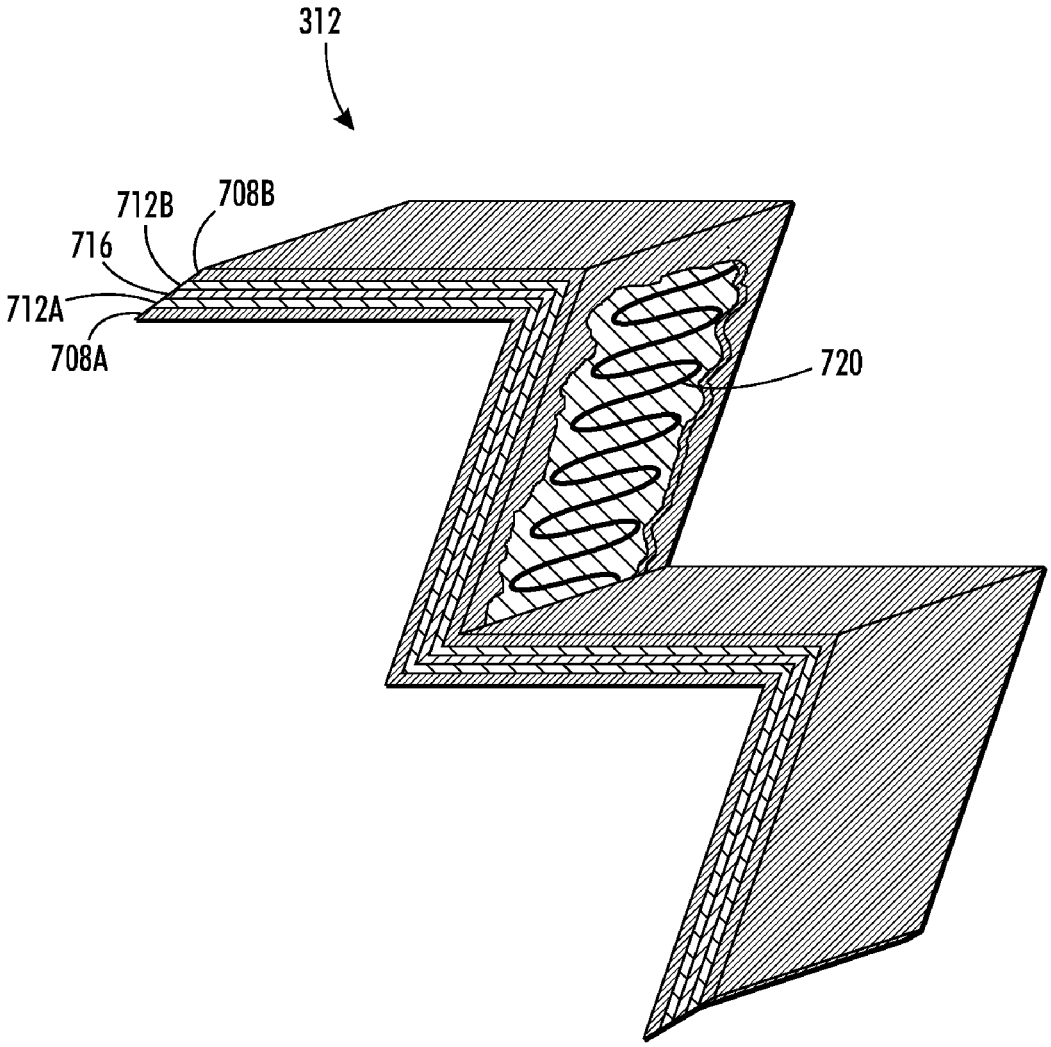
FIG. 7 is a cut-away view of a folded strip heater element that may be placed in a solid ink reservoir.

FIG. 7 depicts heater element 312 in more detail. The heater element is a strip heater and includes an electrical insulating layer 716, thermoset adhesive layers 712A and 712B, metallic overlays 708A and 708B, and electrically resistive heater trace 720. Strip heater 312 includes at least one heater trace configured to conduct electricity received from leads 306. FIG. 7 shows a heater trace 720 in a cut away view. A second heater trace (not shown) extends over the lower surface of layer 716. Heater trace 720 has a serpentine pattern and generates heat in response to an electrical current applied to the heater trace 720. As used herein, the term "serpentine" refers to a shape or patterns including any series or combination of linear or curved paths, turns and direction changes that may be used to form a heater element. Thermoset adhesive layers 712A and 712B bond the electrical insulating layer with heater traces 716 to metallic overlays 708A and 708B, respectively. The metallic overlays 708A and 708B act as thermal conductors that enable heat generated by heater traces 720 to heat the ink more rapidly and uniformly for melting. Two suitable materials for the metallic outer layers are stainless steel and aluminum, although other materials may be used. While FIG. 7 depicts metallic outer layers on both sides of the strip heater 312, alternative heater elements may use a single metallic layer or substrate. Bonding material and the metallic overlay provide an isolating function that eliminates chemical interaction with the heater traces. The metallic overlay also minimizes the possibility of overheating of portions of the heater element not submerged in the fluid within the volume of the reservoir. Any appropriate configuration and material make up of heater strip element 312, as well as layer descriptions, may differ from the above without affecting suitability for the described use.

Referring again to FIG. 3 and FIG. 4, temperature sensor 324 may be a thermistor or other temperature-sensing device suited for use in an ink reservoir. Temperature sensor 324 extends from the top of housing 304 into the ink 310, although various embodiments may use one or more temperature sensors at different positions in the ink reservoir 200.

Controller 336 may be an electronic control device, such as controller 70 from FIG. 1, or may be embodied as a thermostat. Controller 336 receives temperature information from temperature sensor 324 and selectively opens and closes switch 340 to control a flow of electrical current from electrical power source 344 to heater element 312 via electrical leads 306. Switch 340 may be an electromechanical or solid state switch.

In an operating mode where ink 310 is maintained in a molten state, controller 336 selectively opens and closes switch 340 in response to the reservoir temperature detected by temperature sensor 340. When the signal generated by the temperature sensor 340 indicates that the ink temperature is below a predetermined lower temperature threshold, controller 336 closes switch 340 to enable electric current from electrical power supply 344 to flow through heater element 312. The temperature of heater element 312 increases in response to the electrical current, heating ink in the ink reservoir 308. When the temperature of ink 310 reaches an upper threshold temperature that is higher than the lower threshold temperature, controller 336 opens switch 340 to remove electric current from the heater element 312. Alternatively, a more precise control method may use a temperature change rate or predetermined temperatures approaching offsets from the lower or upper temperature set points to initiate a change in the current delivered to the heater and/or on/off cycling frequency. One form of this type of "switch" is a PID controller. Lower and upper temperature thresholds for some embodiments of phase change ink that may be used are 110° C. and 125° C., respectively.

In another mode of operation, ink 310 occupies reservoir volume 308 in a solid phase. Controller 336 may open switch 340 to allow the ink 310 to cool and solidify according to various energy saving programs and techniques that are known to the art. Ink 310 may also solidify when a printing device is disconnected from electrical power for a time period sufficient to allow the ink to cool to the freezing point. When melting solidified ink, controller 336 closes switch 340 to enable electrical current from electrical power source 344 to flow through leads 306 and heater element 312. Heater element 312 applies heat uniformly across width 356 of reservoir volume 308. Due to the proximity of heater element 312 to inkjet ejectors 416, ink 310 near the ejectors 416 melts more quickly than ink in portions of the reservoir volume 308 that are farther from the inkjet ejectors 416. Thus, the ejectors 416 receive melted ink in a uniform manner across the width of the printhead and melted ink is available for ejection through the plurality of ejectors even if a portion of the ink 310 remains solid.

The embodiments described above are merely illustrative and are not limiting of alternative embodiments. For example, the PTC heater elements of FIG. 2, FIG. 5, FIG. 6A, and FIG. 6B and the folded strip heating element of FIG. 3, FIG. 4, and FIG. 7 may be used in a larger ink reservoir used to supply ink to one or more printheads or may be used in a printhead reservoir. Various implementations are described in context with either a strip heater or a PTC heater. In all cases, printhead, reservoir, and various non-heater components are compatible with either heating technology. For example, housing material, venting, temperature feedback control, reservoir volume, and fluid level volume limits may be used with either type of heater. Heater elements may be orientated in any way relative to the reservoir. Configurations incorporating angled folds, bends, holes, voids and the like enable gravity to urge liquefied ink to reservoir outlets. While FIG. 1 depicts an indirect phase-change imaging device, the heater elements and reservoirs described above are equally suited for use in other embodiments of phase-change ink imaging devices including direct marking devices. Additionally, the features described are suitable for use with imaging devices using one or multiple ink reservoirs and for imaging devices using one or more colors of ink.

It will be appreciated that variations of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A volumetric container for storage of ink in a solid inkjet printer comprising:

a housing comprised of thermally insulating material, the housing having a volume of space internal to the housing, the volume of space having a height, a width, and a depth; and a heater element positioned within the volume of space of the housing to melt ink uniformly across the width of the volume of space, the heater element being configured to have a surface area that is greater than an area defined by the height and width of the volume of space and a parametric volume of the heater element is greater than 50% of a fluid volume completely filling the volume of space within the housing.

2. The volumetric container of claim 1 wherein at least a portion of the heater element extends below a low limit fluid level in the volume of space.

3. The volumetric container of claim 1, the housing further comprising:

a printing apparatus fluidly connected to the volume of space to receive melted ink from the volume of space for ejection from the printing apparatus.

4. The volumetric container of claim 3 wherein the heater element is positioned to enable at least a portion of the heater element proximate an outlet fluidly communicating with the printing apparatus to melt solid ink proximate the outlet more quickly than solid ink in a remaining portion of the volume of space to enable printing with the printing apparatus before all of the solid ink in the volume of space is melted.

5. The volumetric container of claim 1 wherein the thermally insulating material is a thermoset plastic.

6. The volumetric container of claim 1 wherein the heater element is positioned proximate a bottom of the volume of space within the housing to enable at least a portion of the heater element to remain submerged in ink within the volume of space.

7. The volumetric container of claim 1 wherein the heater element includes material having a positive temperature coefficient (PTC).

8. The volumetric container of claim 7 wherein the heater element is a perforated block of PTC material.

9. The volumetric container of claim 7 wherein the heater element is a plurality of folded vanes of PTC material.

10. The volumetric container of claim 7 wherein the PTC material extends from a top of the volume of space to a bottom of the volume of space.

11. A volumetric container for storage of ink in a solid inkjet printer comprising:

a housing comprised of thermally insulating material, the housing having a volume of space internal to the housing, the volume of space having a height, a width, and a depth; and a heater element positioned within the volume of space of the housing to melt ink uniformly across the width of the volume of space and configured to have a surface area that is greater than an area defined by the height and width of the volume of space, the heater element further comprising:

electrical traces formed in a serpentine pattern on a corrugated heater element;

a metallic substrate positioned adjacent the corrugated heater element; and a thermoset adhesive affixing the metallic substrate to the heater element to isolate the heater element from physical contact with ink in the volume of space within the housing.

12. The volumetric container of claim 11, the heater element being folded multiple times to increase parameteric thickness and reduce a length of the heater element by at least one fourth.

13. The volumetric container of claim 12 wherein the heater element is oriented to enable closed ends of folds in the heater element to be positioned higher than open ends of the heater element.

14. The volumetric container of claim 11 wherein the heater element includes material having a positive temperature coefficient (PTC).

15. A volumetric container for storage of ink in a solid inkjet printer comprising:

a housing comprised of thermally insulating material, the housing having a volume of space internal to the housing, the volume of space having a height, a width, and a depth;

a heater element positioned within the volume of space of the housing to melt ink uniformly across the width of the volume of space and configured to have a surface area that is greater than an area defined by the height and width of the volume of space;

electrical leads operatively connected to the heater element to couple electrical power from an external electrical power source to enable activation of the heater element, the electrical leads exiting the housing at an upper portion of the housing to facilitate replacement of the heater element;

a temperature sensor positioned within the volume of space to enable the temperature sensor to sense a temperature of ink stored in the volume of space within the housing;

a controller operatively connected to the temperature sensor to enable the controller to receive a signal generated by the temperature sensor that corresponds to the temperature of the ink stored in the volume of space within the housing, the controller being configured to compare the signal received from the temperature sensor to a predetermined threshold; and a switch operatively connected to the controller and the electrical power source, the switch being configured to connect the electrical power source to the electrical leads to activate the heater element in response to the controller identifying the signal received from the temperature sensor as being less than the predetermined threshold and to disconnect the electrical power source from the electrical leads to deactivate the heater element in response to the controller identifying the signal received from the temperature sensor as being equal to or greater than the predetermined threshold.

16. The volumetric container of claim 15 wherein the heater element includes material having a positive temperature coefficient (PTC).

17. The volumetric container of claim 16 wherein the heater element is a perforated block of PTC material.

18. The volumetric container of claim 16 wherein the heater element is a plurality of folded vanes of PTC material.

19. The volumetric container of claim 16 wherein the PTC material extends from a top of the volume of space to a bottom of the volume of space.

* * * * *